US010330449B2

(12) United States Patent
Fix et al.

(10) Patent No.: US 10,330,449 B2
(45) Date of Patent: Jun. 25, 2019

(54) DISPENSER AND DISPENSING SYSTEM FOR RADAR JAMMING MATERIAL

(71) Applicant: RAYTHEON COMPANY, Waltham, MA (US)

(72) Inventors: Martin G. Fix, Waltham, MA (US); Stephen A. Streib, Waltham, MA (US)

(73) Assignee: Raytheon Company, Waltham, MA (US)

( * ) Notice: Subject to any disclaimer, the term of this patent is extended or adjusted under 35 U.S.C. 154(b) by 397 days.

(21) Appl. No.: 14/808,410

(22) Filed: Jul. 24, 2015

(65) Prior Publication Data

US 2017/0023342 A1 Jan. 26, 2017

(51) Int. Cl.
*F42B 12/70* (2006.01)

(52) U.S. Cl.
CPC ..... *F42B 12/70* (2013.01)

(58) Field of Classification Search
CPC ..... B26F 1/384; B26D 7/204; B26D 1/34; B26D 1/40; B26D 1/405; F42B 12/70
USPC ..... 83/343, 346, 347, 331, 649, 650, 950
See application file for complete search history.

(56) References Cited

U.S. PATENT DOCUMENTS 2,783,878 A * 3/1957 Traver ..... B65H 35/002 225/44
2,969,169 A * 1/1961 Botnick ..... B65H 35/0006 225/38
3,519,221 A 7/1970 Kifor
4,286,498 A * 9/1981 Block ..... F42B 12/70 102/505
4,304,517 A 12/1981 Ulin
5,011,059 A * 4/1991 Jennings, Jr. ..... B65H 16/021 225/35
5,172,841 A * 12/1992 Friedman ..... A47F 13/045 225/42
5,179,778 A * 1/1993 Dickson ..... B01D 39/2017 29/33 F
5,305,937 A * 4/1994 Barnett ..... B65H 35/002 225/37
5,461,960 A 10/1995 Marks et al.
5,639,043 A * 6/1997 Baird ..... B65H 59/02 242/125.3
5,894,773 A * 4/1999 Sevenish ..... C03B 37/16 83/100
5,941,476 A * 8/1999 Copass ..... B65H 35/002 206/391
6,105,481 A * 8/2000 Schuler ..... B26D 1/045 83/578
6,604,444 B1 * 8/2003 Belanger ..... B26D 1/626 83/117

(Continued)

*Primary Examiner* — Jason Daniel Prone
*Assistant Examiner* — Richard D Crosby, Jr.
(74) *Attorney, Agent, or Firm* — Burns & Levinson, LLP; Joseph M. Maraia

(57) ABSTRACT

A dispensing unit and system for area suppression and/or countermeasure materials includes at least one canister with two ends, a support rod including a portion extending between the ends along an axis rotatably engaged with the first end, a wall defining a cavity for housing at least one material bundle, an aperture in the first end for dispensing material from the bundle, and a support structure providing horizontal support for the at least one canister. Dispensing systems include a roving cutting mechanism.

18 Claims, 5 Drawing Sheets

(56) References Cited

U.S. PATENT DOCUMENTS 6,666,351 B1 * 12/2003 Hartz ..... B64D 1/02 102/342
7,073,745 B2 * 7/2006 Flis ..... B43K 29/12 242/160.1
D530,947 S * 10/2006 Garcia-Elste ..... D6/520
7,614,331 B2 * 11/2009 Schaefer ..... A47F 7/17 225/6
7,819,362 B2 * 10/2010 Hale ..... B64D 1/16 137/899.2
8,033,507 B2 * 10/2011 Fox, Jr. ..... B64D 17/383 244/151 B
8,485,098 B2 * 7/2013 Gaisbauer ..... F41J 2/02 102/254
8,677,904 B2 * 3/2014 Rexford ..... F42B 12/42 102/342
8,695,847 B2 4/2014 Sjobeck et al.
8,720,829 B2 5/2014 Zatterqvist
8,967,440 B2 * 3/2015 Chang ..... B65H 35/002 225/2
9,097,501 B2 * 8/2015 Gaisbauer ..... F41J 2/02
9,169,015 B2 * 10/2015 Le Croller ..... F41A 9/72
9,428,272 B2 * 8/2016 Markov ..... B64D 1/16
10,001,351 B2 * 6/2018 Secco ..... F42B 4/26
2004/0011235 A1 * 1/2004 Callaway ..... F41J 2/02 102/336
2004/0200332 A1 * 10/2004 Chen ..... B65H 49/205 83/648
2005/0109179 A1 * 5/2005 Behringer ..... B26D 1/0006 83/331
2006/0065095 A1 * 3/2006 Ambrose ..... A47K 10/38 83/650
2007/0068353 A1 * 3/2007 Piucci ..... B65H 35/0006 83/311
2007/0137454 A1 * 6/2007 DesRosiers ..... B26D 1/045 83/614
2009/0193962 A1 * 8/2009 Zachrisson ..... F41F 3/042 89/1.801
2012/0018581 A1 1/2012 Melin
2013/0167711 A1 * 7/2013 Zatterqvist ..... B64D 1/02 89/1.56
2014/0097569 A1 * 4/2014 Sposato, Jr. ..... B41F 13/60 270/20.1
2014/0150267 A1 * 6/2014 Sowell ..... A01D 34/4166 30/123
2015/0165635 A1 * 6/2015 Pringal ..... B26F 1/08 225/2
2017/0023342 A1 * 1/2017 Fix ..... F42B 12/70

* cited by examiner

DISPENSER AND DISPENSING SYSTEM FOR RADAR JAMMING MATERIAL

STATEMENT REGARDING FEDERALLY SPONSORED RESEARCH

This invention was made with Government support under Contract No. H94003-04-D-0006 awarded by the United States Department of Defense. The Government has certain rights in this invention.

FIELD

This invention relates to systems for in-flight dispensing and cutting of adversarial radar area suppression and countermeasure materials, such as chaff dipole elements, for the protection of aerial vehicles against guided missiles and other radar-based weaponry.

BACKGROUND

Controllably deployable area suppression and countermeasure materials of several types are used to deter and defeat attacks on aircraft by other aircraft, missiles, and antiaircraft artillery. In each case, the material is deployed by an aircraft to confuse an attacker, and specifically the sensor used by the attacker, creating a radar-jamming cloud.

A conventional method for the self-protection of aircraft and the like from radar-guided missiles employs a chaff dispenser for ejecting chaff material in the form of pre-cut dipoles, or lengths of reflective or absorptive materials such as metallized glass or graphite fibers, into the airstream immediately along the flight path of the aerial vehicle. One or more cartridges containing dipoles of a length selected in accordance with an expected radar frequency are fired from the dispensing device into the airstream where there is formed a cloud, or bloom, of the chaff which spoofs the radar and thereby provides protection of the vehicle.

Some chaff dispensing systems have been employed that cut chaff dipoles in-flight, but they typically are bulky, heavy and have a relatively slow response time. Chaff bundles typically have round or elliptical cross sections, and they are typically loaded into dispensing systems with their long axes oriented vertically. Chaff rovings are unspooled from the center of the bundle for chopping into desired lengths by the cutter during dispensing operations. The vertical orientation often results, due to a roving bundle's weight (e.g., approximately 50 pounds for common roving bundles) in compression forces that cause the roving bundle to lose its structural support leading to spooling jams when the chaff may be critically needed. Vertical stacking of multiple chaff bundles on top of one another would only exacerbate this fault mode.

Thus, conventional in-flight chaff dispensing systems present a number of problems, and an improved self-protection device has been needed for some time. Therefore, the device of the present invention has been developed to overcome problems associated with such conventional chaff dispensing systems.

SUMMARY OF THE INVENTION

The apparatus and systems described herein are directed to material dispensing applications, designed to minimize jams in unspooling countermeasure and/or area suppression material, such as chaff rovings. The implementations are configured to store for dispensing spools or bundles of the material horizontally with respect to the vehicle in or on which they are mounted, and with respect to ground and normal to the Earth's gravitational force. One or more material bundle may be mounted on a horizontal support rod, from which the materials may be unspooled, reducing jam frequency and making easier dispensing to a cutting mechanism.

In one aspect, the implementations provide a dispensing unit for area suppression and countermeasure materials, including a dispensing canister and a support structure. Each canister may have a first end, a second end having a central axis extending to the first end, a support rod extending at least between the first end and the second end along the central axis, and a wall defining a canister cavity. The support rod may be rotatably engaged with the first end, such that one or the other may spin during material deployment. The wall extends circumferentially around the support rod from the first end to the second end. The canister may be dimensioned to house the rod and at least one material bundle loaded thereupon having a long dimension aligned with the central axis. The first end may have an aperture large enough for material roving to pass through. The canister's position is stably fixed by the support structure, such that the support rod is maintained during material deployment in a horizontal position, parallel to ground and normal with respect to gravitational forces. The canister and support structure cooperate to make the canister cavity easily accessible for re-loading countermeasure material, however single-use canisters are within the scope of the invention.

In certain implementations, the dispenser is configured with a plurality of canisters, which may be arranged lengthwise parallel to a central horizontal axis of the dispenser. Each of the canisters may be supported on a rack unit comprised of one or more plates spaced apart from one another and each including a bore hole to accommodate an associated canister. The canisters may be permanently affixed to, or releasable from, the rack unit. The material may be loaded into the canisters while the canisters are supported by the rack unit, or after removal from the rack unit.

Both ends of the canister may be rotatably engaged with the support rod, or just the first end. The support rod may terminate at, or traverse, the ends. In some implementations, the rod may be connected to the second end in a fixed manner, in which case the second end and rod rotate together with respect to the first end, or vice versa. One or both of the ends may comprise end caps including bearings facilitating the respective rotational relationships.

Implementations also provide a material dispensing system comprised of the dispenser described above, operably engaged with a material roving cutting unit. The cutting unit may be motorized to draw material rovings from one or more canisters in the dispensing unit. As a result of the winding design typical of area suppression and countermeasure materials, such as chaff bundles, the unspooling force exerted by the cutting unit to draw the roving translates into rotational forces on the chaff bundles and results in a rotational spin of either the rod bearing the weight of the chaff bundle, or each canister end having an aperture through which the roving is being drawn. The tensile strength of commercially available area suppression and countermeasure materials is sufficient such that the materials will not break under such unspooling forces.

The cutting unit may include a rotatable cutting head configured with one or more blades disposed across a surface of the cutting head, the blades being spaced apart so as to cut the drawn roving(s) into desired lengths. The cutting head is disposed adjacent to a rotatable roller such, when the cutting head and roller are rotating, a surface of the roller periodically comes into contact with the respective edges of the cutting head blades in order to cut threaded rovings into desired lengths. A drive structure operably engaged with the cutting head and roller provides rotational motive forces sufficient to draw the rovings there between and to cut the rovings into desired lengths. Cutting heads with distinct spacing of cutting blades may be interchanged into the cutting unit, so the lengths into which the rovings will be cut may be selectable. Certain implementations may be further configured with a support rod drive structure, synchronized with the cutting unit, for assisting in providing rotational forces to the support rod bearing the weight of the material bundle.

Other objects and advantages of the implementations described herein will be apparent from the following description and appended claims.

BRIEF DESCRIPTION OF THE DRAWINGS

Further advantages and features of the invention can be derived from the following detailed description of exemplary embodiments of the invention, with reference to the drawings.

DETAILED DESCRIPTION

The implementations described herein are directed to dispensing systems particularly useful for in-flight cutting and dispensing of area suppression and/or countermeasure materials. Such materials may comprise, but are not limited to, "chaff", glass fibers or filaments (e.g. 1 mil diameter) coated with electrically conducting aluminum or other suitable metal, or graphite fibers, hot IR chaff, or other materials that provide reflection or absorption of radiofrequency energy sufficient to confuse and divert radar based missiles aimed at the aircraft, or to create a radar-suppressing cloud dispersing and lingering over a wide area. The dispensed material may include any materials that may be cut into discrete segments, sections, particles, or other subdivided form, for dispensing into an environment in which the material may be useful, e.g., for combating measures directed at or against persons, vehicles, installations, etc., or for preemptive area suppression of radar such as might be desirable in conjunction with an aircraft mission. While the implementations are described primarily with reference to area suppression and/or decoy applications in aircraft, and primarily affecting preferred electromagnetic spectra, the utility of the implementations is not thus limited, but extends to a wide variety of other placements and applications.

The implementations overcome problems inherent in dispensing systems that store area suppression and countermeasure materials (e.g., chaff bundles) vertically, and allow easy dispensing to a roving cutter. Providing horizontal support for the weight of the roving in a manner that doesn't interfere with chaff unspooling permits use of longer chaff bundles and/or the use of multiple bundles strung together in a lengthwise fashion. These features permit greater amounts of material to be stored in the dispensing system, and greatly reduce the frequency of unspooling jams. Dispensing systems described herein may be used with existing roving winding designs, which may be comprised of helical or circumferential windings around a central core of a roll or bundle. However, the improvement in load distribution may permit greater amounts of chaff, in bigger or longer bundles, to be developed and employed. Features of the implementations also lend themselves to easier feed access of the roving to the cutter, and re-loading (e.g., standard aircraft automated loaders may be employed for heavier, round or cylindrically-shaped objects.)

Figure 1:
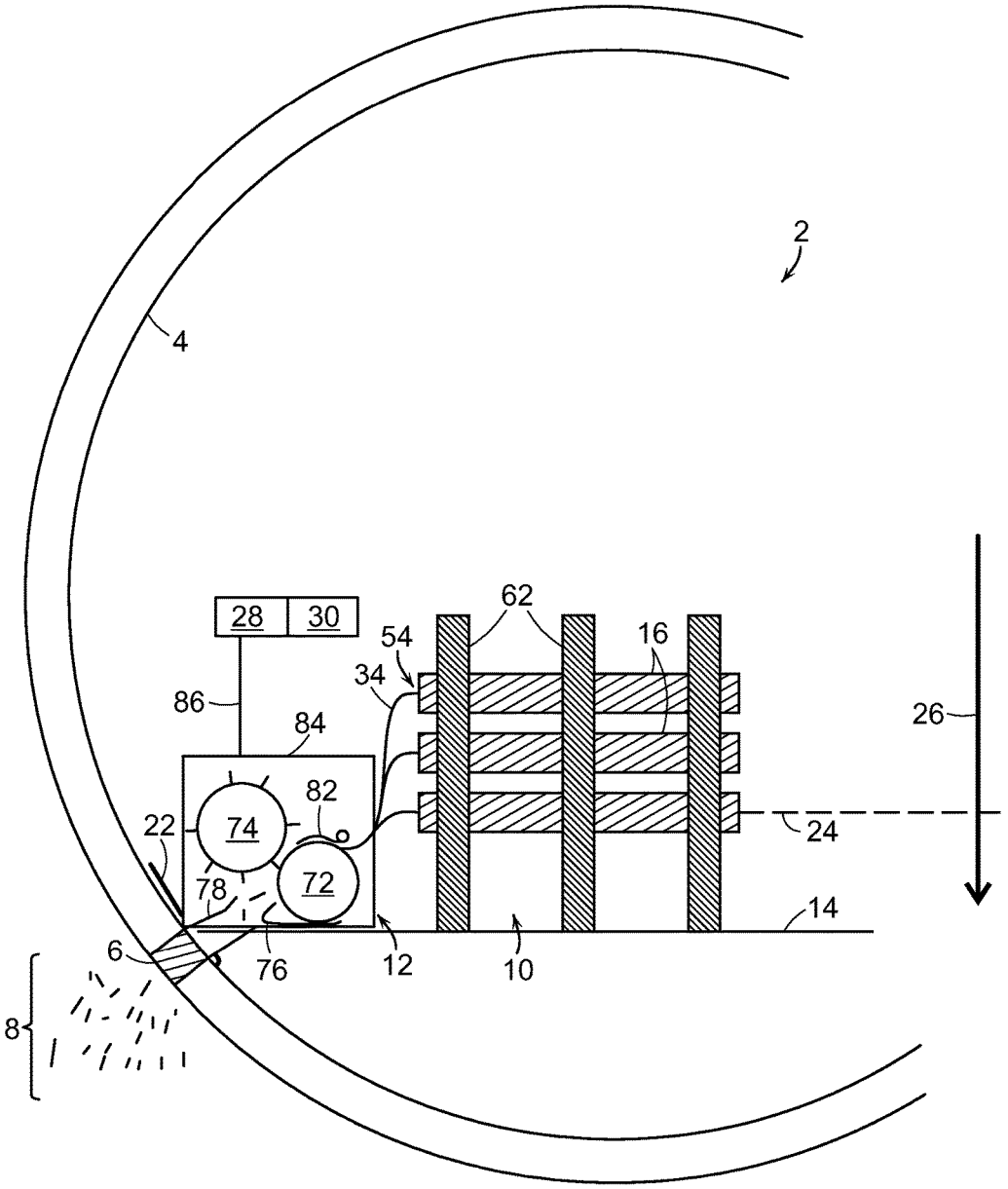
FIG. 1 is a perspective view illustrating an implementation of the dispensing system, in an example mounting configuration within the fuselage of an aircraft.
Figure 2:
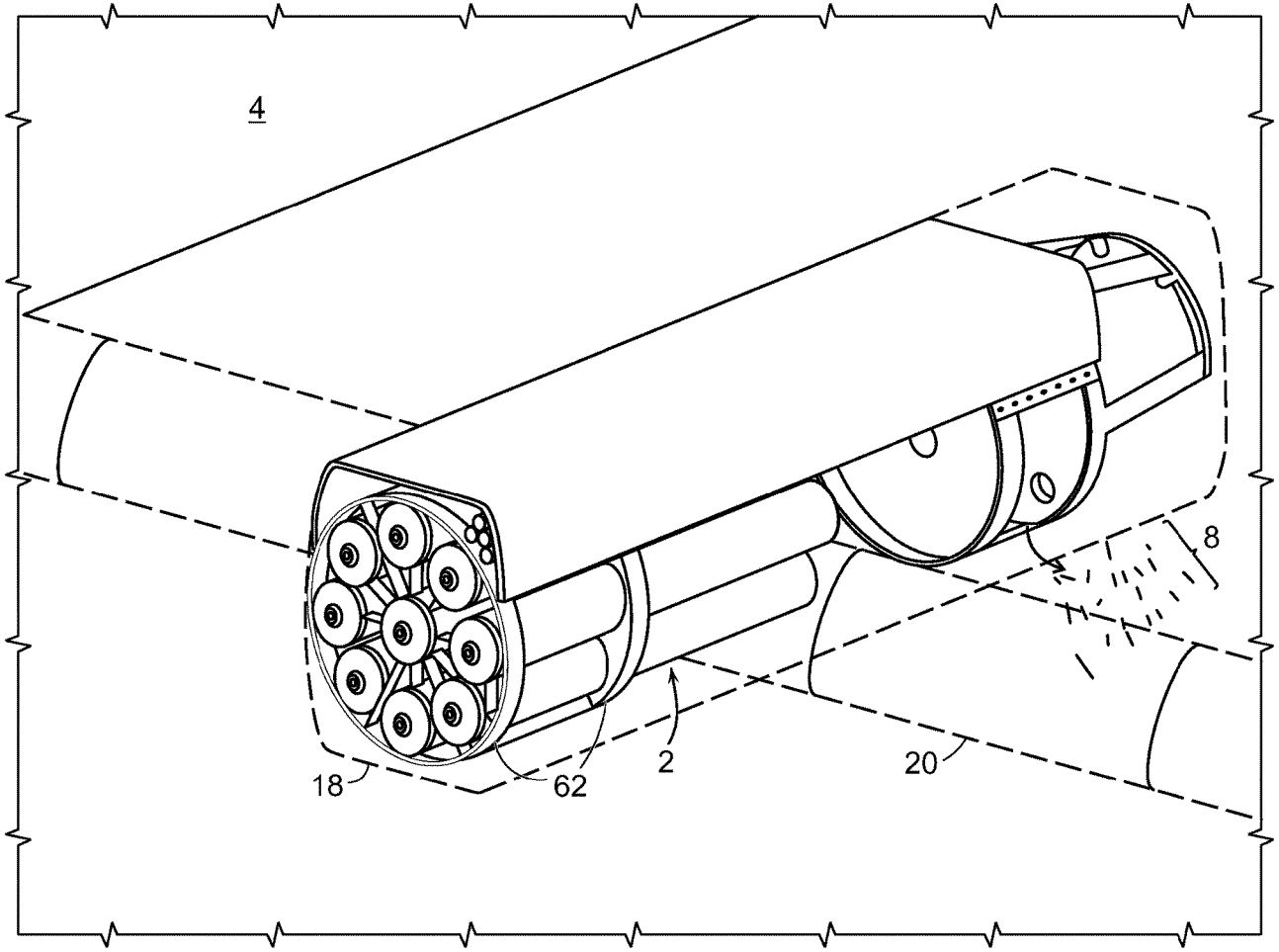
FIG. 2 is a perspective view illustrating an implementation of a dispensing unit, in an example mounting configuration in a housing mounted on an aircraft wing, wherein a dispensing system housing and aircraft wing are cut away.

In FIG. 1, a dispensing system 2 according to certain implementations is illustrated within an aircraft fuselage 4. FIG. 1 is an axial view of the aircraft fuselage 4 provided with an example hatch 6 representing a pathway through which chopped area suppression and/or countermeasure materials (materials 8) may be dispensed. The fuselage 4 may be any aircraft that either might itself be subject to threats from radar, IR or laser sensor-based weaponry (e.g., missiles), or which might be purposed for dispensing a wide-area cloud of radar-suppression capability for the protection of other aircraft. Such weaponry can be fired either from other aircraft or from the ground. The dispensing system 2 may dispense chopped materials 8 from hatch 6. In the configuration shown, dispensing system 2, which may be comprised of dispensing unit 10 and cutting unit 12, is fixedly mounted to or on a support surface 14 within the aircraft (e.g., the floor. However, any mounting configuration (wall, ceiling, bracket, etc.) may be used that maintains a substantially fixed spatial relationship between dispensing unit 10 and cutting unit 12, and a substantially horizontal orientation for canisters 16 with respect to ground and planetary gravitational force during operation. FIG. 2 illustrates another potential mounting configuration, in which the dispensing system 2 is housed in a self-contained housing 18 mountable on the underside of an aircraft's wing 20.

With continued reference to FIG. 1, dispensing unit 10 may be operably engaged with cutting unit 12, which chops the material into desired lengths for dispensing through hatch 6. The chopped material 8 may be simply released into the airstream, or alternatively ejected by ejection means such as a piston and/or pressurized gas. Hatch 6 may comprise a moveable hatch cover 22 over an opening in the aircraft fuselage 4. The dispenser 10 and cutting unit 12 are shown supported by a level support surface 14, proximate hatch 6, such that each canister 16 for storing dispensing material may be horizontally oriented such that its central axis 24 is substantially parallel with respect to ground and normal with respect to gravitational force (shown as force line 26.) In an airplane mounted configuration, this would likely mean mounting the dispensing system such that the canister(s) 16 are disposed substantially horizontally in an imaginary plane parallel with the airplane's wings;

A control unit 28 and power supply 30 for providing on-command motive force to the cutting unit 12 may be connected to the dispensing system 2. The control unit 28 and power supply 30 may be remotely located from the dispensing unit 2 (e.g., the control unit may be located in the cockpit of the aircraft), but are connected to the dispensing system 2 by electrical cables 86. It is also possible to arrange control unit 28 and power supply 30 as two separate units remote from one another.

Figure 3:
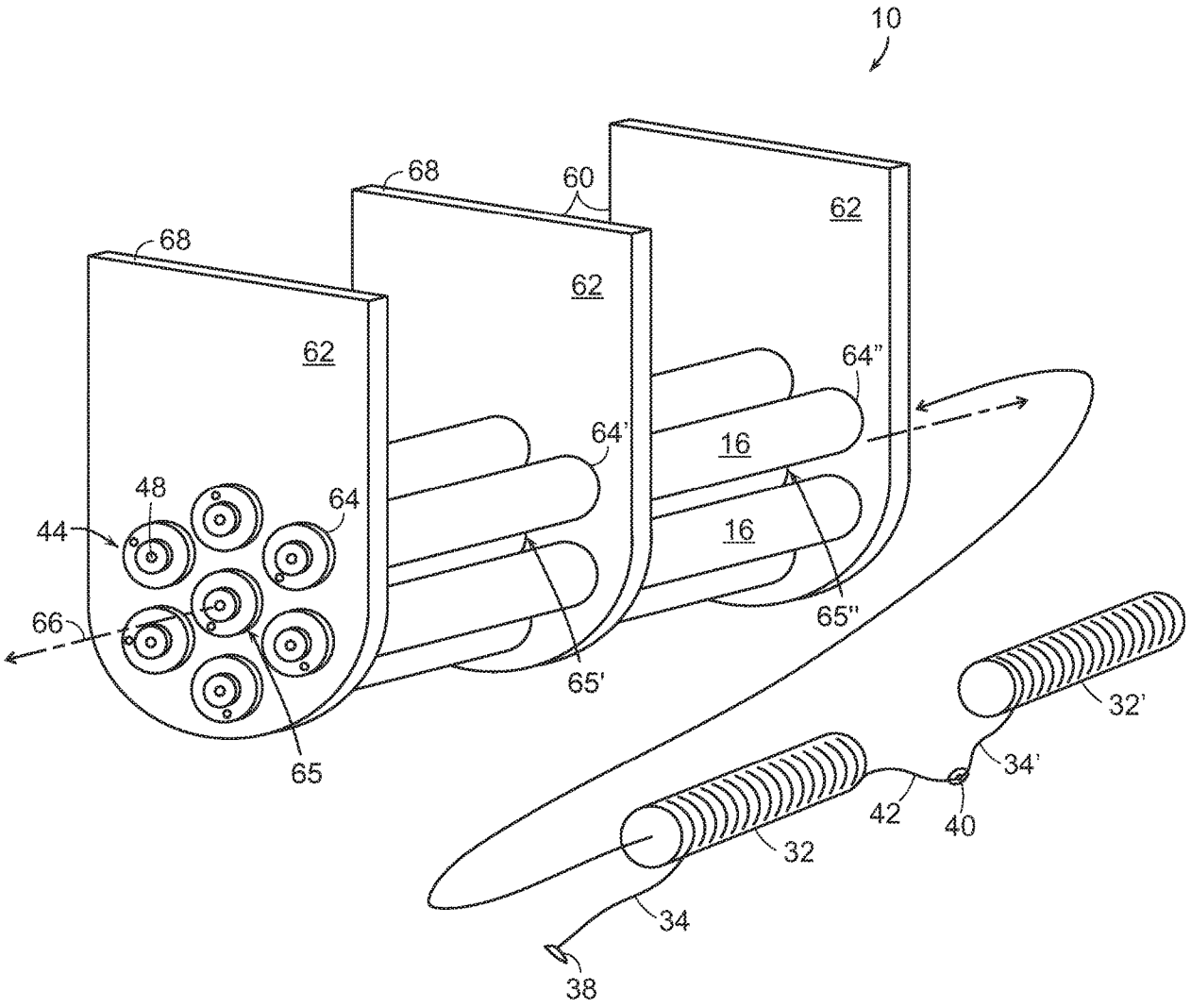
FIG. 3 is an illustration of an embodiment of a dispensing unit, isolated from the dispensing system.

As shown in FIG. 3, a chaff bundle 32 typically comprises a wound roll of material roving 34 having a round or elliptical cross section. The leading or feed end 36 of each strand of material roving 34 may be provided with a thin, flat roving threading tab 38 to facilitate the threading of the roving 34 into cutting unit 12 when the chaff bundle 32 is loaded into a canister 16 of the dispensing unit 10. Each roving 34 may also be provided with a fastener 40 at its trailing (i.e., non-feed) end 42 permitting the trailing end 42 to be fastened to the feed end 34' of another chaff bundle 32', or the roving ends 34', 42 may simply be tied together. This allows more than one chaff bundle 32, 32', and a greater amount of chaff or other material, to be loaded into a canister 16, and reduces the need to re-load canisters. As shown, dispensing unit 10 may be configured with any number of canisters 16. Commercially available chaff bundles typically have cross-sectional diameters of approximately 12", and while such dimensions can be accommodated, the advantageous weight-bearing features of the present invention permits larger dimensioned bundles to be used.

Figure 4A:
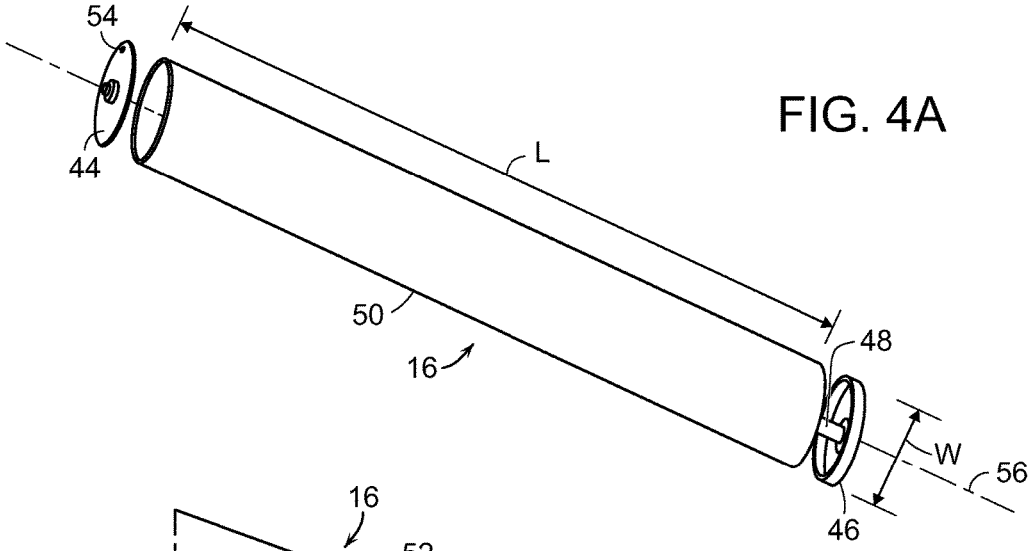
FIGS. 4A-4C are exploded and axial views of an embodiment of a dispenser canister.
Figure 4B:
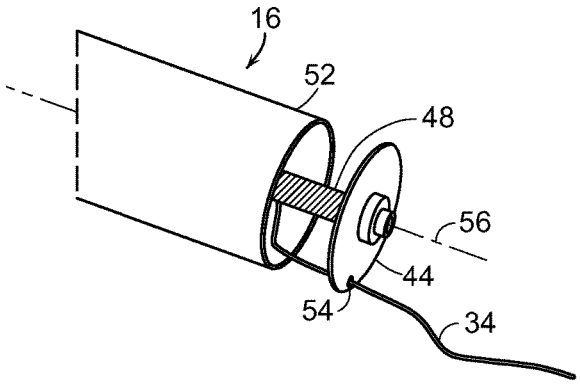
Figure 4C:
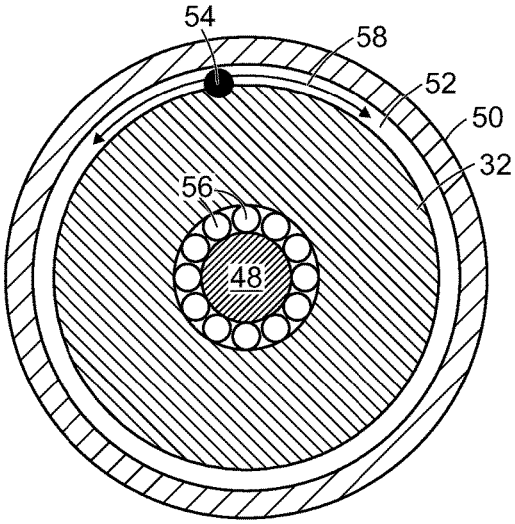

With reference to FIGS. 4A-4C, implementations of canister 16 may have a first end cap 44, a second end cap 46, a support rod 48, and a wall 50 enclosing a cavity 52. Canister 16 may be dimensioned so as to have sufficient width W and length L to house in its cavity 52 one or more chaff bundles 32 oriented with its long dimension coinciding with the long dimension (L) of canister 16. Suitable materials for constructing the canisters 16 are characteristically strong and relatively light weight, such as aluminum and/or similar metal materials. In certain implementations, however, where canister 16 may be intended for a single use, it may be composed of a durable, disposable material, such as thick cardboard. The dispenser wall may be made of a relatively thin sheet metal, preferably about ⅛-⅜ inch or more thick, formed by extrusion or molding into the desired shape (shown as cylindrical, but this is not intended to be limited to such shape.) FIG. 4B presents an expanded view, and FIG. 4C an axial view, of certain implementations of first end cap 44 of canister 16. First end cap 44 may comprise an end cap that may be fitted, screwed, latched or otherwise reversibly connected to wall 50 to partially define cavity 52. First end cap 44 includes an aperture 54 disposed therein dimensioned so as to permit area suppression and countermeasure material roving 34 to be drawn from the chaff bundle 32 loaded onto rod 48 in cavity 52.

Support rod 48 extends between first end cap 44 and second end cap 46 along an axis 56 axially traversing the center of the cavity 52 defined by the end caps 44, 46 and wall 50. Support rod 48 has an outer diameter no greater than the diameter of a hollow core of chaff bundle 32, in order that chaff bundle 32 may be loaded onto support rod 48. Upon loading, support rod 48 bears the weight of chaff bundle 32. A fastener (not shown) may be utilized to secure chaff bundle 32 to support rod 48. Support rod 48 may be rotatably engaged with at least first end cap 44. In certain embodiments, this may be achieved by the inclusion, in first end cap 44, of journal or ball bearings 56 configured in a concentric manner and dimensioned so as to receive and permit free rotation of support rod 48 with respect to first end cap 44. In some embodiments, support rod 48 rotates during material deployment, as a result of material roving 34 being drawn through aperture 54. The tensile force on roving 34 when it is pulled by the cutting unit causes the roving to unspool from the chaff bundle 32. Due to the circumferential winding configuration of a chaff bundle 32, unspooling of roving 34 affects a rotational force (indicated by arrow 58) on the chaff bundle 32. The rotational force on chaff bundle 32 may translate into a rotational force on support rod 48 onto which chaff bundle 32 is loaded, particularly when there exists a secure fit between chaff bundle 32 and support rod 48 due to tight dimensioning and/or fastening. Drawing the roving 34 through aperture 54 while the weight of the chaff bundle 32 is supported by rod 48 eliminates the likelihood of unspooling jams experienced by conventional dispensing systems, wherein the weight of vertically oriented chaff bundles may lead to collapsing of the bundle.

Support rod 48 may be similarly rotationally engaged with second end cap 46. Alternatively, second end cap 46 may rotate with support rod 48, if it is affixed thereto. The latter configuration may require the additional use of a journal or ball bearings joint between second end cap 46 and canister wall 50 to permit second end cap 46 to rotate. In certain implementations, either or both end caps 44, 46 may comprise end caps that are removable from wall 50. For example, an end cap at second end cap 46 may be removed in order to access to canister cavity 52 to load one or more chaff bundles 32 onto support rod 48. In other implementations, the canisters 16 may be intended for a single use, so end access for re-loading is optional.

Figure 5:
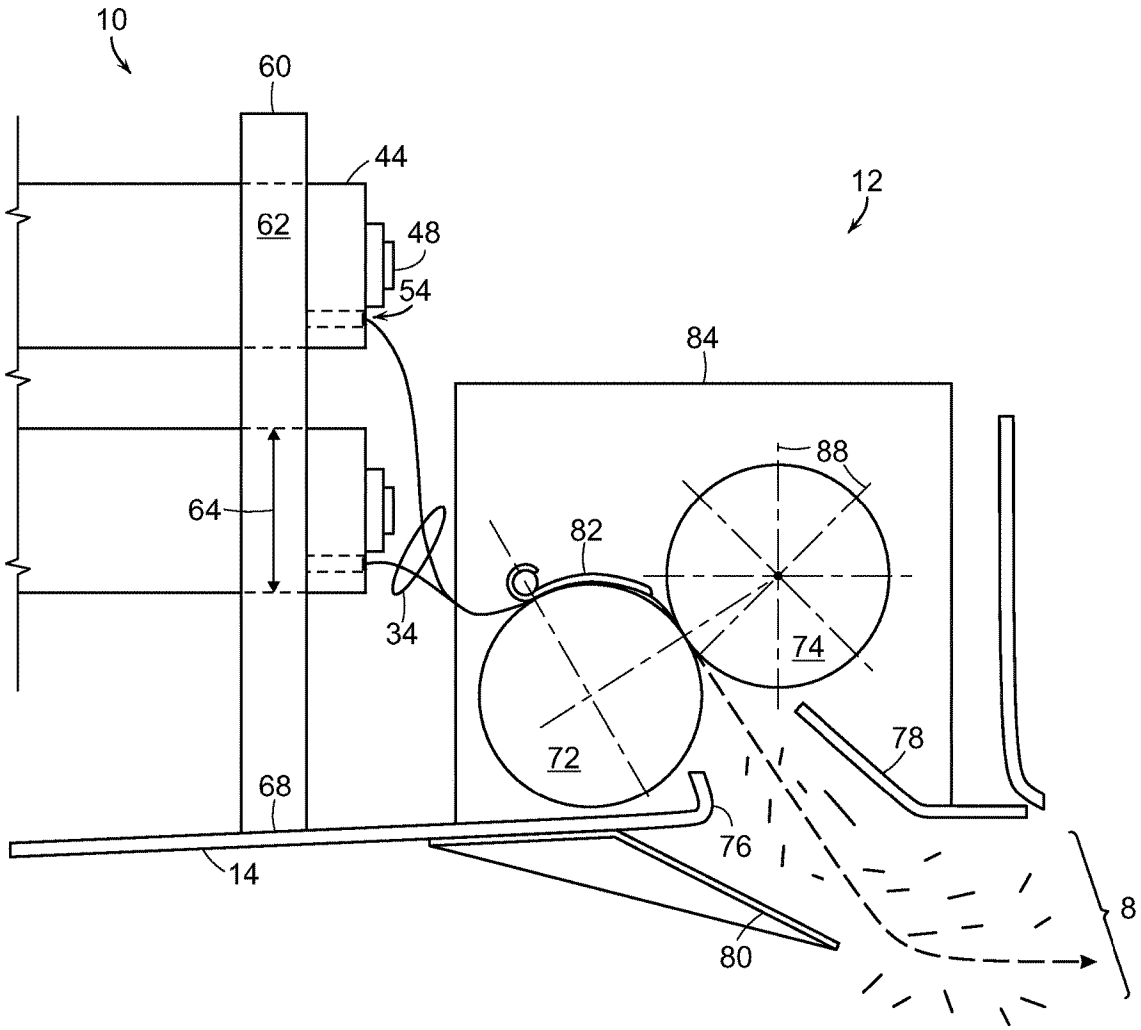
FIG. 5 is a sectional end view of an embodiment of a cutting unit and its interface with an end of the dispensing unit.

With reference to FIGS. 3 and 5, the canisters 16 of dispensing unit 10 may be disposed within, or on, a support structure 60. Any construction may be utilized that has the strength and stability to bear the weight of canisters 16 loaded with material, and which provides easy access to the canister cavity for material loading. For example purposes, support structure 60 is illustrated as rack comprised of three parallel plates 62 (two spoked plates are shown in FIG. 2). In certain implementations, one or both of the canister end caps 44, 46 are accessible for removal in order to reload material, while canister 16 is being supported by rack plates 62. Alternatively, the canisters 16 may be releasably mounted in rack plates 62, such that they may be removed from the plates when material reloading is required.

Each plate 62 may include at least one bore 64 corresponding to a bore 64' in another plate(s). Any number of bores 64 and corresponding canisters 16 may be configured in dispensing unit 10. The illustrated implementations, for example, present two, seven, and nine-canister configurations, with canisters arranged symmetrically around a central axis 66 and/or central bores 65, 65', 65", wherein rack plates 62 each have a corresponding set of bores 64, 64', 64" and central bores 65, 65', 65". Each bore 64 may be arranged and dimensioned so as to receive and support at least one canister 16, such that the support rod 48 of canister 16 may be oriented during area suppression and/or countermeasure material deployment substantially horizontally with respect to ground, and normal with respect to gravitational forces. An absolute horizontal orientation of the rods is not a necessity, and may not be possible in circumstances requiring countermeasure deployment (i.e., when an aircraft is attempting to evade radar weaponry.) However, performance of the dispensing system 2 improves when the support rods 48 near horizontal orientation. For clarity, FIG. 3 illustrates exemplary upward facing dispenser unit mounting surfaces 68 useful in wing-mounted configurations, while FIG. 5 illustrates exemplary downward facing mounting surfaces 68 for floor mounting configurations.

Dispensing unit 10 and cutting unit 12 are preferably configured in a relatively fixed orientation and spacing with respect to one another such that, when chaff rovings 34 are being unspooled from the one or more canisters 16 of dispensing unit 10, tensile stress fluctuations on the rovings 34 are minimized. During dispensing operations, each chaff roving 34 may be drawn by the cutting unit 12, unspooling the roving 34 from its respective chaff bundle 32 stored in a canister 16

With continued reference to FIGS. 1 and 5, dispensing unit 2 operably engages cutting unit 12. Support surface 14 may be provided with an elongated opening 70 extending along the length of and located below platen roller 72 and cutter roller 74, such that chopped countermeasure 8 fall through the opening 70 and exit the dispensing system 2. Inwardly extending guide walls 76 and 78 on the forward and aft sides of opening 70 guide the chopped material 8 out of the system. In certain implementations, the chopped material 8 may be guided toward at least one hatch 6 (see FIG. 1.) The system may also be configured, as necessary, with bobbins and/or spools (not shown) to additionally guide the rovings 34 to the rollers. In other implementations, such as wing-mounted configurations, an optional spoiler member 80 (see FIG. 5) positioned below the support surface 14 and extending along the opening 70, assists in dispensing the chopped material 8 into the airstream along the flight path of the aircraft.

A guide 82 may be positioned near the roving dispensing ends (first end caps 44) of canisters 16 and upstream of rollers 72 and 74. The guide 82 may comprise an elongated, smooth, curved plate for guiding and slightly pressing the rovings 34 from the canisters 16- to the nip of rollers 72 and 74. When a chaff bundle 32 is inserted into canister 16, the feed ends 36 of the rovings are pulled from the canister 16 through apertures 54 threaded into the nip of rollers 72 and 74, so that when the rollers are rotated, the rovings 34 are automatically drawn between the rollers under guide 82 for cutting.

Cutting unit 12 may include a drive structure 84 (shown in block form) that includes a drive shaft, flywheel and rotors as are well known in the art. The drive shaft may be connected to the rotor of a drive clutch assembly, while the stator of the clutch assembly may be connected to a gear assembly for driving one, or both of the cutter roller 74 and the platen roller 72, to rotate with respect to the other, perhaps both rotating in opposite directions. Drive structure 84 may include an electrical motor, with an electrical cable 86 extending to controller 28 and power supply 30 that command the operation of the drive structure 84, and, thus, the dispensing system. Controller 28, which may include a switching device, electrically connects electric power supply 30 to drive structure 84 and outputs signals to each of its components to activate and/or deactivate the operations thereof, and thus control the rotation of the cutter roller 74 and/or the platen roller 72. In certain embodiments, the drive structure 84 may additionally provide rotational motive force to each support rod 48. Drive structure 84 may synchronize, electrically or mechanically, the rotation of the rollers 72, 74 and the support rods 48, in order to assist in rotating the rods.

Platen roller 72 may be formed from rubber or another suitable elastomer, while the cutter roller 74 may be formed of steel or another suitable material. Cutter roller 74 is configured with a plurality of cutter blades 88, extending along the length of and spaced around the circumference of the roller for cutting the strands of roving 34 to a suitable length. The spacing of the blades 88 around the circumference of roller 74 will determine the length of the dipoles cut. A number of replacement cutter rollers 74 may be interchanged to enable the cutting of dipoles of varying lengths. The knife-edge blades 88 are mounted in precisely machined grooves spaced around the circumference of the cutter roller 74, and the cutter roller may be constructed in a manner well-known in the art. Guide 82 may extend the length of the platen roller 72 for maintaining a slight pressure on the strands of roving drawn into the nip of rollers 72 and 74. Sufficient pressure is maintained by the blades 88 against the surface of the platen roller 72 to ensure proper countermeasure cuts.

Although various specific embodiments and illustrative features have been described, it will be recognized that the invention is not thus limited, except as by the appended claims, and that variations, modifications and other embodiments are contemplated and are to be broadly construed.

What is claimed is:

1. A dispensing unit for dispensing material roving from an airplane having wings parallel to an imaginary plane, comprising:

a first rack member including a first bore;

a second rack member spaced a distance from the first rack member and including a second bore;

at least one canister extending through the first rack member via the first bore and the second rack member via the second bore, each canister comprising:

a first end cap;

a second end cap having a central axis extending to the first end cap;

a support rod including a portion extending between the first end cap and the second end cap along the central axis, the support rod rotatably engaged with the first end cap;

a wall extending circumferentially about the support rod from the first end cap to the second end cap and defining a cavity for housing at least one material bundle-elongated parallel to the central axis; and an aperture defined by the first end cap, the aperture sized to allow material roving to be withdrawn from the at least one material bundle through the first rack member via the first end cap; and wherein the first rack member and the second rack member are configured to support the at least one canister such that the support rod is oriented in the imaginary plane.

2. The dispensing unit of claim 1, wherein the first end cap has a first axis coaxially aligned with the central axis of the second end cap.

3. The dispensing unit of claim 2 wherein the aperture is at a location offset from the first axis of the first end cap such that when material roving is drawn through the aperture by a tensile force, a rotational force is applied by the material roving to a corresponding material bundle.

4. The dispensing unit of claim 1, wherein the first end cap has a first axis parallel to the central axis of the second end cap.

5. The dispensing unit of claim 1, wherein the first end cap has a first end cap bore for rotatably engaging with the support rod.

6. The dispensing unit of claim 1, wherein the second end cap has a second end cap bore for rotatably engaging the support rod.

7. The dispensing unit of claim 1, wherein the at least one canister further comprises a plurality of canisters.

8. The dispensing unit of claim 7, wherein the rack members comprise an associated plurality of bores for receiving the plurality of canisters, the plurality of bores arranged radially in a rack with a central angle of less than 180 degrees.

9. The dispensing unit of claim 8, wherein the associated plurality of bores further comprises a central bore.

10. The dispensing unit of claim 1, wherein the cavity is dimensioned to hold a plurality of countermeasure bundles.

11. The dispensing unit of claim 1, wherein the canister cavity is repeatably accessible through the first end cap or the second end cap for loading the at least one material bundle into the canister cavity.

12. A material dispensing system for dispensing countermeasure roving from an airplane, comprising:

a material dispensing unit comprising at least one canister, each canister comprising:

a first end cap;

a second end cap having a central axis extending to the first end cap;

a support rod including a portion extending between the first end cap and the second end cap along the central axis, the support rod rotatably engaged with the first end cap;

a wall extending circumferentially about the support rod from the first end cap to the second end cap and defining a cavity for housing at least one countermeasure elongated parallel to the central axis;

an aperture defined by the first end cap and having an aperture central axis normal to the aperture, the aperture sized for dispensing countermeasure roving from the at least one countermeasure bundle; and a first rack member including a first bore and a second rack member including a second bore, the first rack member and second rack member configured for attachment to a support structure to support the at least one canister such that: the at least one canister extends through the first rack member via the first bore and the second rack member via the second bore;

and the rod is oriented substantially parallel to the support structure; and a material cutting unit operably engaged with the dispensing unit so as to: draw at least one countermeasure roving therefrom; cut the at least one countermeasure roving; and provide the at least one cut countermeasure roving to guide walls of the material cutting unit for directing the at least one cut countermeasure roving out of the airplane.

13. The material dispensing system of claim 12, wherein the material cutting unit comprises:

a cutter roller disposed to rotate about a cutter roller axis and having a plurality of blades disposed across a surface of the cutter roller;

a platen roller disposed adjacent to the cutter roller to rotate about a platen roller axis and to have a surface in momentary contact with each of the one or more blades of the cutter roller; and a drive structure providing motive force for rotating either or both of the cutter roller and the platen roller so as to draw at least one countermeasure roving between the cutter roller and the platen roller.

14. The material dispensing system of claim 13, wherein the motive forces drive the cutter roller and platen roller such that the countermeasure roving is cut into desired lengths.

15. The material dispensing system of claim 12, further comprising a drive structure operably engaged with each support rod of each of the at least one dispensing unit to controllably turn each support rod.

16. The material dispensing system of claim 12 wherein:

the support structure is configured for attachment to a support surface of the airplane.

17. The material dispensing system of claim 16, wherein the material cutting unit further comprises:

guide walls; and a platen roller and an adjacent cutter roller configured to draw the at least one countermeasure roving from the dispensing unit, cut the at least one countermeasure roving, and provide the at least one cut countermeasure roving to guide walls, wherein the guide walls configured to direct the chopped countermeasure out of the material dispensing system.

18. A dispensing unit for dispensing material roving from an airplane, comprising:

a first rack member including a first bore;

a second rack member spaced a distance from the first rack member and including a second bore;

at least one canister extending along a central axis running orthogonally to the first rack member and second rack member, the at least one canister extending through the first rack member via the first bore and the second rack member via the second bore, each canister comprising:

a support rod having a first end cap and a second end cap, the support rod including a portion extending between the first end cap and the second end cap along the central axis, the support rod rotatably engaged with the first end cap;

a wall extending circumferentially about the support rod from the first end cap to the second end cap and defining a cavity for housing at least one material bundle-elongated parallel to the central axis; and an aperture defined by the first end cap, the aperture sized to allow material roving to be withdrawn from the at least one material bundle through the first rack member via the first end cap; and wherein the first rack member and the second rack member are configured to support the at least one canister within the airplane such that the support rod is oriented substantially parallel to the central axis.

* * * * *